US010726804B2

(12) United States Patent
Yang et al.

(10) Patent No.: US 10,726,804 B2
(45) Date of Patent: Jul. 28, 2020

(54) DISPLAY DEVICE AND DISPLAY DRIVING METHOD THEREOF

(71) Applicants: HEFEI BOE OPTOELECTRONICS TECHNOLOGY CO., LTD., Hefei, Anhui (CN); BOE TECHNOLOGY GROUP CO., LTD., Beijing (CN)

(72) Inventors: Qing Yang, Beijing (CN); Jiacheng Huang, Beijing (CN)

(73) Assignees: HEFEI BOE OPTOELECTRONICS TECHNOLOGY CO., LTD., Hefei, Anhui (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/241,384

(22) Filed: Jan. 7, 2019

(65) Prior Publication Data

US 2019/0287472 A1 Sep. 19, 2019

(30) Foreign Application Priority Data

Mar. 15, 2018 (CN) ..... 2018 1 0215138

(51) Int. Cl.
*G09G 3/36* (2006.01)

(52) U.S. Cl.
CPC ..... *G09G 3/3618* (2013.01); *G09G 3/3648* (2013.01); *G09G 2310/027* (2013.01); (Continued)

(58) Field of Classification Search
CPC ..... G09G 2330/021; G09G 2340/0435; G09G 2360/16; G09G 3/3648; G09G 2320/0247; G09G 2320/103
See application file for complete search history.

(56) References Cited

U.S. PATENT DOCUMENTS

2013/0187897 A1 7/2013 Liu
2015/0287352 A1 10/2015 Watanabe et al.
(Continued)

FOREIGN PATENT DOCUMENTS

CN 104813392 A 7/2015
CN 103218964 B 1/2016
(Continued)

OTHER PUBLICATIONS

First Office Action dated Mar. 25, 2020 for corresponding Chinese application 201810215138.1.

*Primary Examiner* — Koosha Sharifi-Tafreshi
(74) *Attorney, Agent, or Firm* — Nath, Goldberg & Meyer; Joshua B. Goldberg

(57) ABSTRACT

A display device and a display driving method thereof are disclosed. The method includes: acquiring a grayscale of each pixel in a pixel matrix of a to-be-output image of the display device, wherein the pixel matrix comprises a plurality of pixels in a plurality of pixel rows, and each pixel row comprises multiple pixels; determining a refresh type and a refresh rate for the to-be-output image according to the grayscale of each pixel in the pixel matrix, wherein the refresh type comprises a single-frequency refresh and a multi-frequency refresh; and refreshing pixel voltages of the pixel matrix at a single determined refresh rate under the single-frequency refresh, or refreshing the pixel voltages of the pixel matrix at a plurality of determined refresh rates under the multi-frequency refresh.

17 Claims, 5 Drawing Sheets

(52) U.S. Cl.
CPC . *G09G 2310/08* (2013.01); *G09G 2320/0247* (2013.01); *G09G 2320/0626* (2013.01); *G09G 2340/0435* (2013.01)

(56) References Cited

U.S. PATENT DOCUMENTS

| | | | | |
|---|---|---|---|---|
| 2015/0379945 | A1 | 12/2015 | Kubota et al. | |
| 2016/0189682 | A1 | 6/2016 | Liu | |
| 2017/0140713 | A1* | 5/2017 | Liu | G09G 3/2018 |
| 2017/0140718 | A1* | 5/2017 | Liu | G09G 3/3607 |
| 2019/0005862 | A1 | 1/2019 | Zhang | |

FOREIGN PATENT DOCUMENTS

| | | | |
|---|---|---|---|
| CN | 105825822 | A | 8/2016 |
| CN | 106205460 | A | 12/2016 |
| CN | 106710539 | A | 5/2017 |
| CN | 107170403 | A | 9/2017 |

* cited by examiner

DISPLAY DEVICE AND DISPLAY DRIVING METHOD THEREOF

CROSS-REFERENCE TO RELATED APPLICATION

This application claims the priority to Chinese Patent Application No. 201810215138.1, filed on Mar. 15, 2018, the contents of which are incorporated herein in their entirety by reference.

TECHNICAL FIELD

The present disclosure relates to the field of display technology, and particularly relates to a display driving method of a display device, a display device and a non-transitory readable storage medium.

BACKGROUND

In a display device in the related art, a pixel voltage cannot remain unchanged for a long time due to the restriction of the current manufacturing process of thin film transistors (TFTs), and the entire screen needs to be refreshed at a fixed refresh rate. For example, for an a-si screen, the grayscale duration is generally 22 ms, that is, the lowest frame frequency is 45 Hz. However, such a display device has large power consumption.

SUMMARY

The present disclosure is intended to alleviate or solve at least one of the technical problems in the related art to some extent.

To this end, embodiments of the present disclosure provide a display driving method of a display device, which can realize low power consumption without compromising on display quality.

Embodiments of the present disclosure also provide a display device and a non-transitory readable storage medium.

In one aspect, an embodiment of the present disclosure provides a display driving method of a display device, including steps of: acquiring a grayscale of each pixel in a pixel matrix of an image to be output by the display device, wherein the pixel matrix includes a plurality of pixels in a plurality of pixel rows, and each of the plurality of pixel rows includes multiple pixels; determining a refresh type and a refresh rate for the image to be output according to the grayscale of each pixel in the pixel matrix, wherein the refresh type includes a single-frequency refresh and a multi-frequency refresh; refreshing pixel voltages of the pixel matrix at a single determined refresh rate under the single-frequency refresh, or refreshing the pixel voltages of the pixel matrix at a plurality of determined refresh rates under the multi-frequency refresh.

According to the display driving method of the display device according to the embodiment of the present disclosure, the grayscale of each pixel in the pixel matrix of the image to be output by the display device is acquired, and the refresh type and the corresponding refresh rate(s) for the image to be output are determined according to the grayscale of each pixel in the pixel matrix, and the pixel voltages of the pixel matrix are refreshed at one determined refresh rate under the single-frequency refresh, or refreshed at a plurality of determined refresh rates under the multi-frequency refresh. Thus, the pixel voltages can be refreshed differently according to different grayscales of the pixels, thereby realizing low power consumption display without compromising on display quality.

According to an embodiment of the present disclosure, determining a refresh type and a refresh rate for the image to be output according to the grayscale of each pixel in the pixel matrix includes: determining whether the grayscale of each pixel in the pixel matrix belongs to a same grayscale level; if the grayscale of each pixel in the pixel matrix belong to the same grayscale level, determining that the refresh type for the image to be output is the single-frequency refresh, and using a refresh rate corresponding to the same grayscale level as the refresh rate for the image to be output.

According to an embodiment of the present disclosure, if the grayscales of the plurality of pixels in the pixel matrix belong to at least two different grayscale levels, determining that the refresh type for the image to be output is the multi-frequency refresh, and determining a plurality of refresh rates for the image to be output according to the grayscale of each pixel.

According to an embodiment of the present disclosure, determining a plurality of refresh rates for the image to be output according to the grayscale of each pixel includes: acquiring a minimum grayscale of each of the plurality of pixel rows of the pixel matrix; dividing the plurality of pixel rows into a plurality of pixel groups according to the minimum grayscale of each of the plurality of pixel rows, wherein each of the plurality of pixel groups includes at least one pixel row; and using a refresh rate corresponding to the grayscale level to which a minimum grayscale of each pixel group belongs as the refresh rate for the pixel group.

According to an embodiment of the present disclosure, dividing the plurality of pixel rows into a plurality of pixel groups according to the minimum grayscale of each of the plurality of pixel rows includes: determining whether the minimum grayscale of each pixel row and the minimum grayscale of an adjacent pixel row belong to a same grayscale level; and dividing consecutive pixel rows whose minimum grayscales belong to a same grayscale level into a same pixel group.

According to an embodiment of the present disclosure, after dividing consecutive pixel rows whose minimum grayscales belong to a same grayscale level into a same pixel group, the method further includes: determining a number of the divided pixel groups, and determining whether the number of the divided pixel groups is greater than a preset threshold; if the number of the divided pixel groups is greater than the preset threshold, merging the divided pixel groups such that the number of the pixel groups after the merging is smaller than or equal to the preset threshold.

According to an embodiment of the present disclosure, merging the divided pixel groups includes: merging a plurality of consecutive pixel groups in each of which the number of rows of the pixel rows is smaller than a first preset threshold into a same pixel group; or merging two adjacent pixel groups whose minimum grayscales belong to adjacent grayscale levels into a same pixel group.

According to an embodiment of the present disclosure, after dividing the plurality of pixel rows into a plurality of pixel groups according to the minimum grayscale of each of the plurality of pixel rows, the display driving method further includes: determining whether a number of rows in each of the plurality of pixel groups is greater than a preset row number; if the number of rows in any of the plurality of pixel groups is greater than the preset row number, demerging the pixel group such that the number of rows in each pixel group after the demerging is smaller than the preset row number.

According to an embodiment of the present disclosure, determining a plurality of refresh rates for the image to be output according to the grayscale of each pixel includes: acquiring, among the plurality of pixel rows of the pixel matrix, a pixel row including a low grayscale pixel, wherein the low grayscale pixel is a pixel whose grayscale belongs to a first grayscale range; dividing the plurality of pixel rows into a plurality of pixel groups according to the pixel row including the low grayscale pixel, wherein each of the plurality of pixel groups includes at least one pixel row; and determining a refresh rate for the pixel group including the low grayscale pixel in the plurality of pixel groups and a refresh rate for other pixel group than the pixel group including the low grayscale pixel in the plurality of pixel groups, respectively, and using the refresh rate for the pixel group including the low grayscale pixel and the refresh rate for the other pixel group as the plurality of refresh rates for the image to be output.

According to an embodiment of the present disclosure, determining a refresh rate for the pixel group including the low grayscale pixel in the plurality of pixel groups and a refresh rate for other pixel group than the pixel group including the low grayscale pixel in the plurality of pixel groups, respectively includes: taking, as the refresh rate for the pixel group including the low grayscale pixel, a refresh rate corresponding to a grayscale level to which a minimum grayscale in the pixel group including the low grayscale pixel belongs, and taking, as the refresh rate for the other pixel group not including the low grayscale pixel, a refresh rate corresponding to a grayscale level to which a minimum grayscale in the other pixel group belongs; or, taking a first preset refresh rate as the refresh rate for the pixel group including the low grayscale pixel, and taking a second preset refresh rate as the refresh rate for the other pixel group, the first preset refresh rate being greater than the second preset refresh rate.

According to an embodiment of the present disclosure, dividing the plurality of pixel rows into a plurality of pixel groups according to the pixel row including the low grayscale pixel includes: sequentially determining whether the low grayscale pixel is included in each of the plurality of pixel rows, if a number of rows of pixel rows between two adjacent pixel rows each including the low grayscale pixel is smaller than a second preset threshold, dividing the two adjacent pixel rows each including the low grayscale pixel and the pixel rows therebetween into a same pixel group, and if the number of rows of the pixel rows between the two adjacent pixel rows each including the low grayscale pixel is greater than or equal to the second preset threshold, dividing the two adjacent pixel rows each including the low grayscale pixel into two pixel groups, and dividing the pixel rows between the two adjacent pixel rows each including the low grayscale pixel into another pixel group.

According to an embodiment of the present disclosure, after dividing the plurality of pixel rows into a plurality of pixel groups according to the pixel row including the low grayscale pixel, the display driving method further includes: determining whether a number of rows in each of the plurality of pixel groups is greater than a preset row number, if the number of rows of any of the plurality of pixel groups is greater than the preset row number, demerging the pixel group such that the number of rows in each pixel group after the demerging is smaller than the preset row number.

According to an embodiment of the present disclosure, determining a plurality of refresh rates for the image to be output according to the grayscale of each pixel includes: determining a grayscale level to which a grayscale of each pixel in the pixel matrix belongs; and taking a refresh rate corresponding to the grayscale level to which the grayscale of each pixel belongs as the refresh rate for the pixel. According to an embodiment of the present disclosure, determining a plurality of refresh rates for the image to be output according to the grayscale of each pixel includes: acquiring a low grayscale pixel in the pixel matrix, the low grayscale pixel being a pixel whose grayscale belongs to a first grayscale range; determining a refresh rate for the low grayscale pixel in the pixel matrix and a refresh rate for other pixel than the low grayscale pixel in the pixel matrix, respectively, and taking the refresh rate for the low grayscale pixel and the refresh rate for the other pixel as the plurality of refresh rates for the image to be output.

According to an embodiment of the present disclosure, determining a refresh rate for the low grayscale pixel in the pixel matrix and a refresh rate for other pixel than the low grayscale pixel in the pixel matrix, respectively includes: taking, as the refresh rate for the low grayscale pixel, a refresh rate corresponding to a grayscale level to which a minimum grayscale of the low grayscale pixel belongs, and taking, as the refresh rate for the other pixel, a refresh rate corresponding to a grayscale level to which a minimum grayscale of the other pixel belongs; or, taking a first preset refresh rate as the refresh rate for the low grayscale pixel, and taking a second preset refresh rate as the refresh rate for the other pixel, the first preset refresh rate being greater than the second preset refresh rate.

According to an embodiment of the present disclosure, the pixel voltages of the pixel matrix may be refreshed by a gate driving circuit or a source driving circuit of the display device, wherein in a case of refreshing the pixel voltages by the source driving circuit, the source driving circuit controls, according to the refresh rate for each pixel, a source of a switching transistor of the pixel to be in an output state at an interval.

According to an embodiment of the present disclosure, controlling the source of the switching transistor of the pixel to be in an output state at an interval includes: determining an interval frame number C for each pixel according to the refresh rate for each pixel; and controlling the source of the switching transistor of the pixel to be in an output state every C frames, where C is a positive integer.

According to an embodiment of the present disclosure, in response to a still image displayed by the display device or a panel self-refresh mode of the display device, the grayscale of each pixel in the pixel matrix of the image to be output by the display device is acquired.

In another aspect, embodiments of the present disclosure provide a display device including a memory, a timing controller, and a display driving program of the display device stored in the memory and operable on the timing controller, the timing controller is configured to implement the display driving method of the display device as described above when executing the display driving program of the display device.

According to the display device provided by the embodiments of the present disclosure, by using the display driving method of the display device, the pixel voltages can be refreshed differently according to different grayscales of the pixels, thereby realizing low power consumption display without compromising on display quality.

In still another aspect, embodiments of the present disclosure provide a non-transitory readable storage medium having a display driving program of a display device stored thereon, the display driving program of the display device being executable by a timing controller to implement the display driving method of the display device as described above.

According to the non-transitory readable storage medium provided by the embodiments of the present disclosure, by implementing the display driving method of the display device, the pixel voltages can be refreshed differently according to different grayscales of the pixels, thereby realizing low power consumption display without compromising on display quality.

The additional aspects and advantages of the present disclosure will be set forth in part in the following description, and, in part, will be apparent from the description, or may be learned by practice of the presented exemplary embodiments.

BRIEF DESCRIPTION OF THE DRAWINGS

The above and/or additional aspects and advantages of the present disclosure will become apparent and readily understood from the following description of embodiments in conjunction with the accompanying drawings, in which.

DETAILED DESCRIPTION

Figure 1:
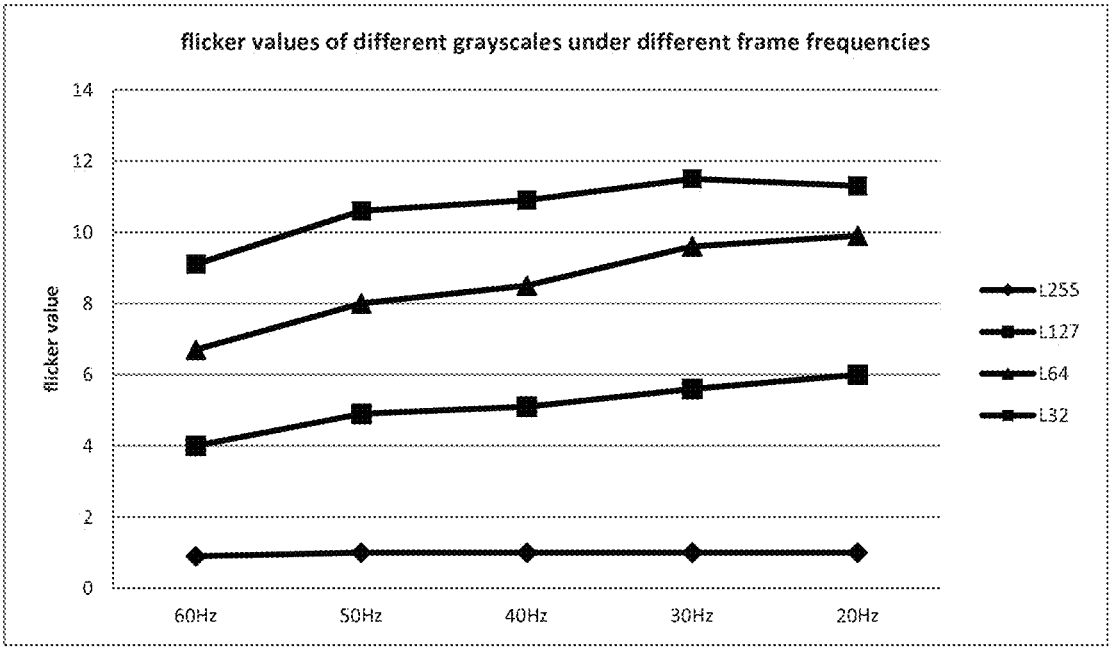
FIG. 1 is a schematic graph showing flicker values for different grayscales under different frame frequencies according to an embodiment of the present disclosure.

The embodiments of the present disclosure are described in detail below, and examples of the embodiments are illustrated in the drawings, wherein the same or similar reference numerals are used to refer to the same or similar elements or elements having the same or similar functions throughout. The embodiments described below with reference to the drawings are intended to be illustrative for explaining the present disclosure only, and are not to be construed as limitations of the present disclosure.

Before describing a display driving method of a display device according to the embodiments of the present disclosure, grayscale duration and screen flicker of the display device will be briefly described.

1) Grayscale duration: refers to the maximum time during which the pixel voltage can be maintained at such a level that human eyes cannot recognize a difference (flicker), and may refer to the time during which the pixel voltage is reduced from 100% to 90%.

2) Screen flicker: in a case where the frame frequency is low enough, because charges of a pixel capacitor cannot be replenished for a long time, the pixel voltage gradually decreases under the influence of a leakage current, the brightness of the pixel is gradually lowered, and the pixel becomes bright suddenly when the next frame arrives. This change in brightness is perceived by human eyes, and is referred to as screen flicker.

The Applicant has measured different grayscale durations of pixels by taking a 10.1-inch LCD (Liquid Crystal Display) device as an example. For ease of measurement, flicker values of different grayscales under different frame frequencies are measured using the CA310 color analyzer to replace the measurement of different grayscale durations. The larger the flicker value, the more obvious the brightness jitter of the pixel under the condition of the frame frequency and the grayscale.

TABLE 1

| | L255 | L127 | L64 | L32 |
|---|---|---|---|---|
| 60 Hz | 0.9 | 4 | 6.7 | 9.1 |
| 50 Hz | 1 | 4.9 | 8 | 10.6 |
| 40 Hz | 1 | 5.1 | 8.5 | 10.9 |
| 30 Hz | 1 | 5.6 | 9.6 | 11.5 |
| 20 Hz | 1 | 6 | 9.9 | 11.3 |

It can be seen from Table 1 and FIG. 1 that the grayscale L32 has the largest flicker value under the condition of frame frequency of 20 Hz, which indicates that the grayscale L32 has a shorter grayscale duration than other grayscales. For the grayscale L255, the grayscale durations under different frame frequencies have no significant change. By analyzing Table 1 and FIG. 1, the Applicant discovered and realized that the higher the grayscale, the longer the grayscale duration.

In addition, the Applicant performed following theoretical computations by taking a 12.6-inch a-si (amorphous silicon) screen with a resolution of 2160*1440 as an example.

Assuming that the capacitance value of a pixel capacitor is Cst=150 fF, the pixel voltage corresponding to L255 is 4.5V, and the maximum leakage current Ioff is 0.5*10^(−12) A, the charge amount Q of the pixel capacitor satisfies: Q=CstV=I*t, the following equation can be obtaining by using the foregoing values: 150*10^(−15)*4.5*(1-90%)=0.5*10^(−12)*t, and it can thus be calculated that t=134 ms. Therefore, the refresh rate suitable for the pixel having a grayscale L255 is f=1/t≈7 Hz. Similarly, the grayscale durations and suitable refresh rates for other grayscales can be obtained, as shown in Table 2.

TABLE 2

| Grayscale | L255 | L224 | L192 | L127 | L64 | L32 | L16 | L8 | L4 |
|---|---|---|---|---|---|---|---|---|---|
| Grayscale voltage(pixel voltage) (V) | 4.5 | 3.4 | 3 | 2.2 | 1.6 | 1.2 | 0.9 | 0.7 | 0.6 |
| Grayscale duration (ms) | 135 | 102 | 90 | 66 | 48 | 36 | 27 | 21 | 18 |
| Suitable refresh rate (Hz) | 7 | 9 | 11 | 15 | 20 | 27 | 37 | 47 | 55 |

By analyzing the above Table 1, Table 2 and FIG. 1, the Applicant discovered and realized that pixels having different grayscales have different grayscale durations, and the lower the grayscale, the shorter the grayscale duration. That is, a pixel requires a higher refresh rate when displaying a low grayscale, and requires a lower refresh rate when displaying a high grayscale.

Based on the above, the present disclosure provides a display driving method of a display device, a display device, and a non-transitory readable storage medium.

A display driving method of a display device, a display device and a non-transitory readable storage medium according to embodiments of the present disclosure are described below with reference to the accompanying drawings.

Figure 2:
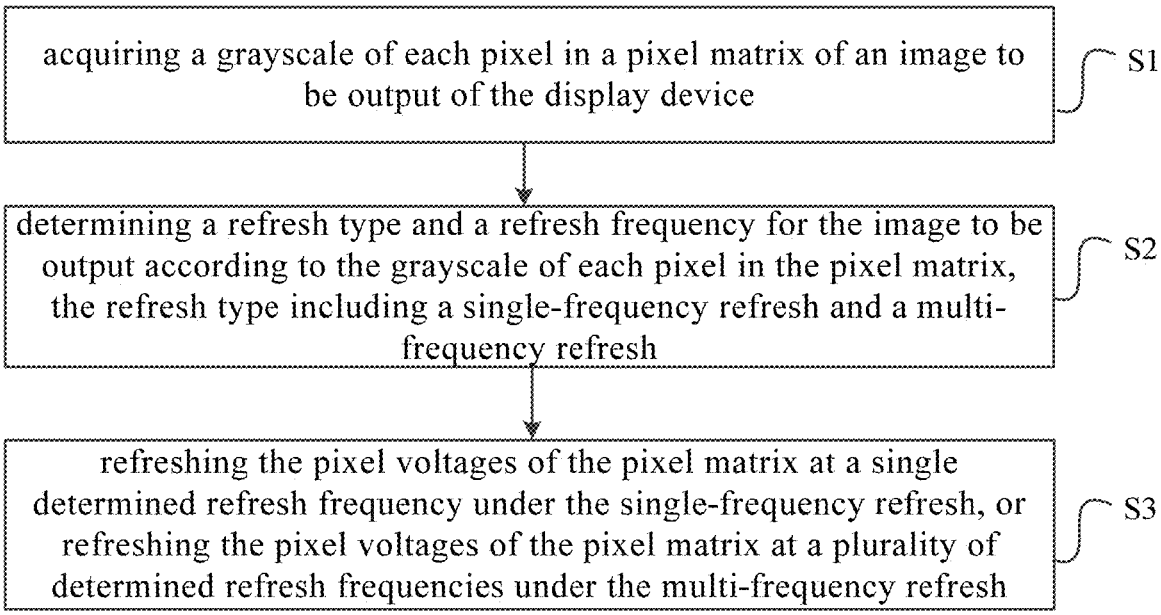
FIG. 2 is a flowchart of a display driving method of a display device according to an embodiment of the present disclosure.

FIG. 2 is a flowchart of a display driving method of a display device according to an embodiment of the present disclosure. As shown in FIG. 2, the display driving method of the display device includes the following steps S1 to S3.

S1 includes: acquiring a grayscale of each pixel in a pixel matrix of an image to be output by the display device. It could be understood that the display device includes a plurality of pixel units arranged in an array, the pixel matrix includes a plurality of pixels, and the plurality of pixel units of the display device arranged in an array are in one-to-one correspondence with the plurality of pixels of the pixel matrix of the image to be output, and the grayscales of the plurality of pixels of the pixel matrix of the image to be output are the grayscales presented by the plurality of pixel units of the display device during display of the image to be output.

S2 includes: determining a refresh type and a corresponding refresh rate for the image to be output according to the grayscale of each pixel in the pixel matrix, and the refresh type includes a single-frequency refresh and a multi-frequency refresh.

It should be noted that the single-frequency refresh refers to refresh at a single frequency, and the multi-frequency refresh refers to refresh at multiple frequencies.

Herein, the pixel voltages may be refreshed by a timing control chip TCON.

It should be noted that, in the debugging phase, the maximum time that each grayscale of the display device can last, that is, the grayscale duration of each grayscale, can be determined as a determination condition for refresh rate of a frame, a row, and a pixel. In an embodiment, the display device can display P grayscales, for example, 256 grayscales of L0 to L255, therefore, the grayscale duration of each grayscale can be first determined, and then the P grayscales are divided into Q grayscale levels, where P and Q are integers and P is greater than or equal to Q.

Each grayscale level may include zero grayscale, that is, a pixel having zero grayscale does not participate in the determination, and the refresh type and the corresponding refresh rate for the image to be output are determined according to the grayscales of pixels other than the pixel(s) having zero grayscale in the pixel matrix.

As shown in Table 3, the grayscales L1 to L255 may be divided into six grayscale levels: L255-L225, L224-L193, L192-L128, L127-L65, L64-L33, and L32-L1. The grayscale level L255-L225 corresponds to a first grayscale level, the refresh rate corresponding to the first grayscale level is 1/a (Hz); the grayscale level L224-L193 corresponds to a second grayscale level, and the refresh rate corresponding to the second grayscale level is 1/b (Hz); the grayscale level L192-L128 corresponds to a third grayscale level, and the refresh rate of the third grayscale level is 1/c (Hz); the grayscale level L127-L65 corresponds to a fourth grayscale level, and the refresh rate corresponding to the fourth grayscale level is 1/d (Hz); the grayscale level L64-L33 corresponds to a fifth grayscale level, the refresh rate corresponding to the fifth grayscale level is 1/e (Hz); the grayscale level L32-L1 corresponds to a sixth grayscale level, and the refresh rate corresponding to the sixth grayscale level is 1/f (Hz). Here, a>b>c>d>e>f. In addition, the first grayscale level to the sixth grayscale level may include zero grayscale L0.

TABLE 3

| grayscale | L255 | L224 | L192 | L127 | L64 | L32 | L0 |
|---|---|---|---|---|---|---|---|
| Grayscale duration (ms) | a | b | c | d | e | f | — |
| Suitable refresh rate (Hz) | 1/a | 1/b | 1/c | 1/d | 1/e | 1/f | — |

It should be noted that the grayscale level corresponding to each grayscale (that is, grayscales included in each level) and the refresh rate corresponding to each grayscale level may be acquired and stored in advance. For example, the grayscales included in and the refresh rate corresponding to each of the six grayscale levels, namely, L255-L225, L224-L193, L192-L128, L127-L65, L64-L33, and L32-L1 as shown in Table 3 may be obtained and stored in advance in the debugging phase.

According to an embodiment of the present disclosure, after acquiring the grayscales of the plurality of pixels of the pixel matrix, at least one characteristic grayscale for determining the refresh rate among the grayscales of the plurality of pixels may be acquired first, then the grayscale level to which each characteristic grayscale of the at least one characteristic grayscale belongs is acquired, and the refresh rate corresponding to the grayscale level to which each characteristic grayscale belongs is acquired, so as to determine at least one refresh rate for the image to be output.

S3 includes: refreshing the pixel voltages of the pixel matrix at a single determined refresh rate under the single-frequency refresh, or refreshing the pixel voltages of the pixel matrix at a plurality of determined refresh rates under the multi-frequency refresh.

That is to say, there is only one refresh rate under the single-frequency refresh, and in this case, the pixel voltages can be refreshed for the pixels at a same refresh rate; there are multiple refresh rates under the multi-frequency refresh, in this case, a pixel row or pixel corresponding to each refresh rate may be determined, and a pixel voltage of the corresponding pixel row or pixel may be refreshed at the refresh rate. In an embodiment, if only one characteristic grayscale is acquired, the refresh rate corresponding to the grayscale level to which the characteristic grayscale belongs is used as the refresh rate for the image to be output, and the pixels of the image to be output are all refreshed at this refresh rate; if a plurality of characteristic grayscales are acquired, a pixel row or pixel corresponding to each characteristic grayscale is determined, and the corresponding pixel row or pixel is refreshed at the refresh rate corresponding to the grayscale level to which each characteristic grayscale belongs.

Therefore, in the method according to the embodiments of the present disclosure, pixel voltages of frames, rows, or pixels displaying different grayscales can be refreshed at different refresh rates according to contents of the image to be output, thereby lowering power consumption of the display device.

In an embodiment of the present disclosure, when the display device displays a still image or is in a panel self-refresh (PSR) mode, the grayscale of each pixel in the pixel matrix of the image to be output by the display device is acquired.

That is, when a specific image (e.g., a standby screen of a notebook computer) or a still image (applications of e-book, digital photo frame, etc.,) is output by TCON, or when the display device is in the PSR mode, the TCON may acquire the grayscale of each pixel in the image to be output by the display device, determine at least one characteristic grayscale, and refresh the pixel voltages at different refresh rates according to the grayscale level to which each characteristic grayscale belongs (that is, refresh the pixel voltages differently).

According to an embodiment of the present disclosure, each of the plurality of pixels includes a switching transistor configured to control the pixel to undergo voltage refresh, a gate of the switching transistor is coupled to the gate driving circuit, and a source of the switching transistor is coupled to the source driving circuit. Here, the refresh may be performed by the gate driving circuit, or the source driving circuit.

According to an embodiment of the present disclosure, in a case where a gate driving circuit such as a Gate IC (Gate Driver IC) or a GOA (Gate on Array in which a gate driving circuit (e.g., a shift register) is directly fabricated on an array substrate) is used to control outputs of rows or frames, the frames or rows having different grayscales may be refreshed at different refresh rates according to the displayed image. In a case where a source driving circuit such as a Source IC (Source Driver IC) is used to control output, frames, rows or pixels having different grayscales may be refreshed at different refresh rates according to the displayed image.

According to an embodiment of the present disclosure, determining the refresh type and the corresponding refresh rate for the image to be output according to the grayscale of each pixel in the pixel matrix includes: determining whether the grayscale of each pixel in the pixel matrix belongs to a same grayscale level, each grayscale level including a plurality of grayscales; if the grayscale of each pixel in the pixel matrix belongs to the same grayscale level, determining that the refresh type for the image to be output is the single-frequency refresh, and taking the refresh rate corresponding to the same grayscale level as the refresh rate for the image to be output.

That is to say, whether the grayscales of the pixels of the image to be output are all belong to a same grayscale level may be determined, and if yes, the image to be output is refreshed using the refresh rate suitable for the grayscale level.

For example, in the case where refresh is performed through the gate driving circuit or the source driving circuit, if the grayscales of the plurality of pixels in the pixel matrix all belongs to the maximum grayscale level (e.g., the first grayscale level L255-L224 in Table 3), the refresh rate corresponding to the maximum grayscale level is used as the refresh rate for the image to be output, and the pixel voltages are refreshed for the plurality of pixels at the refresh rate for the image to be output; if the grayscales of the plurality of pixels are all zero grayscale, the preset minimum refresh rate, that is, the refresh rate corresponding to the maximum grayscale level, is used as the refresh rate for the image to be output, and the pixel voltages are refreshed for the plurality of pixels at the refresh rate for the image to be output; if grayscales of the plurality of pixels include only the 0 grayscale and the 255 grayscale, the preset minimum refresh rate, that is, the refresh rate corresponding to the maximum grayscale level, is used as the refresh rate for the image to be output, and the pixel voltages are refreshed for the plurality of pixels at the refresh rate for the image to be output.

Further, according to an embodiment of the present disclosure, if the grayscales of the plurality of pixels in the pixel matrix belong to at least two different grayscale levels, that is, the grayscales of the plurality of pixels do not belong to a same grayscale level, it is determined that the refresh type of the image to be output is the multi-frequency refresh, and a plurality of refresh rates for the image to be output are determined according to the grayscale of each pixel.

That is to say, if the grayscales of the plurality of pixels in the pixel matrix belong to at least two different grayscale levels, it is indicated that the image includes information of a plurality of grayscale levels, and for the pixel rows or pixels of the image to be output, the pixel voltages may be refreshed at different refresh rates to refresh the pixel voltage of a pixel having a low grayscale in time, so that the pixel voltage of the pixel having the low grayscale can be refreshed and supplemented in time. Here, it should be noted that the at least two different grayscale levels do not include 0 grayscale.

Refresh of the pixel voltages under the multi-frequency refresh will be described in detail below. For ease of explanation, it is assumed that the pixel matrix of the image to be output includes M pixel rows, each of which includes multiple pixels, where M is an integer greater than one.

Figure 4:
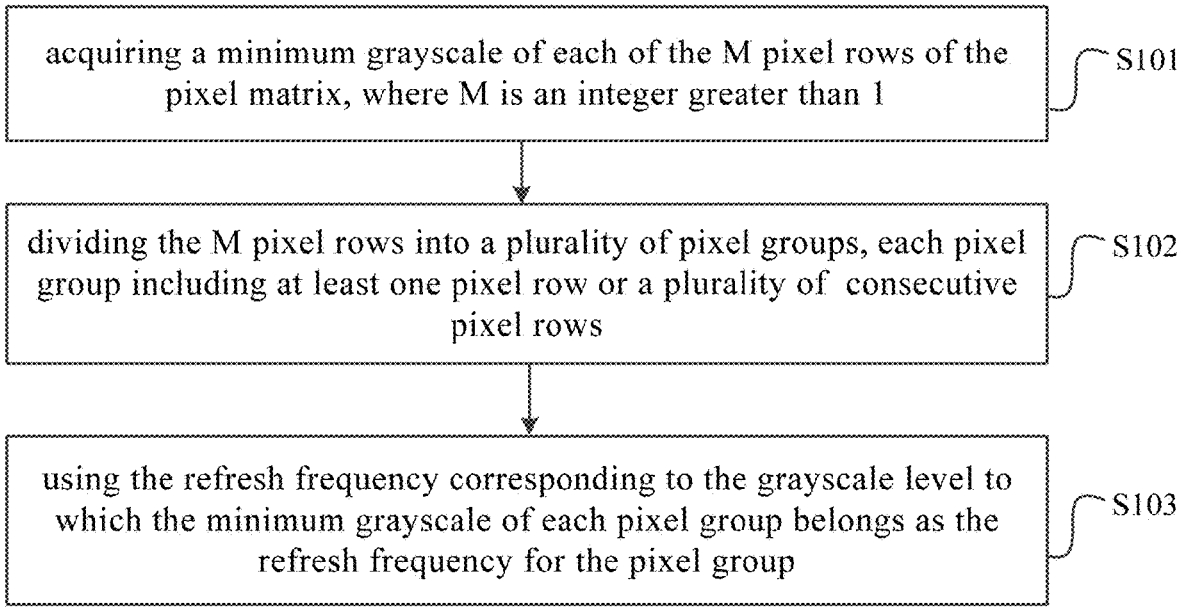
FIG. 4 is a flowchart of a display driving method of a display device according to an embodiment of the present disclosure.

According to an embodiment of the present disclosure, as shown in FIG. 4, determining a plurality of refresh rates for the image to be output according to the grayscale of each pixel includes:

S101: acquiring a minimum grayscale of each of the M pixel rows of the pixel matrix;

S102: dividing the M pixel rows into a plurality of pixel groups according to the minimum grayscale of each pixel row, wherein each pixel group includes at least one pixel row; and S103: using the refresh rate corresponding to the grayscale level to which the minimum grayscale of each pixel group belongs as the refresh rate for the pixel group.

That is to say, the refresh rates for the plurality of pixel groups may be used as the plurality of refresh rates for the image to be output, at which the pixel voltages are refreshed for the pixel matrix, and the pixel voltages may be refreshed for the plurality of pixel groups according to the plurality of refresh rates.

According to an embodiment of the present disclosure, dividing the M pixel rows into a plurality of pixel groups according to the minimum grayscale of each pixel row includes:

determining whether the minimum grayscale of each pixel row and the minimum grayscale of an adjacent pixel row belong to a same grayscale level; and dividing consecutive pixel rows whose minimum grayscales belong to a same grayscale level into a same pixel group.

That is, if the minimum grayscale of the current pixel row and the minimum grayscale of the previous pixel row belong to a same grayscale level, then the current pixel row and the previous pixel row belong to a same pixel group; if the minimum grayscale of the current pixel row and the minimum grayscale of the next pixel row do not belong to a same grayscale level, then the current pixel row and the next pixel row belong to two pixel groups, respectively.

For instance, it is assumed that the minimum grayscales of the pixel rows G1 to G120 belong to a same grayscale level, and the minimum grayscales of the pixel rows G121 to G600 belong to a same grayscale level, the minimum grayscales of the pixel rows G601 to G1080 belong to a same grayscale level, the minimum grayscale of the pixel row G121 and the minimum grayscale of the pixel row G120 do not belong to a same grayscale level, and the minimum grayscale of the pixel row G601 and the minimum grayscale of the pixel row G600 do not belong to a same grayscale level, then the pixel rows G1 to G120 may be divided into a first pixel group, the pixel rows G121 to G600 may be divided into a second pixel group, and the pixel rows G601 to G1080 may be divided into a third pixel group.

Further, after dividing the consecutive pixel rows whose minimum grayscales belong to a same grayscale level into a same pixel group, the method may further include: determining the number of the divided pixel groups, and determining whether the number of the divided pixel groups is greater than a preset threshold; if the number of the divided pixel groups is greater than the preset threshold, merging the divided pixel groups in order that the number of the pixel groups after the merging is less than or equal to the preset threshold. It could be understood that the refresh rate for a merged pixel group is the refresh rate corresponding to the grayscale level to which the minimum grayscale in the merged pixel group belongs.

It should be noted that the preset threshold may be set according to the configuration parameters of the display device. For example, when refresh is performed through a gate driving circuit, a corresponding STV (start vertical signal) may be provided for each pixel group, so as to control the refresh rate of each pixel group through the STV. In this case, the preset threshold may be determined based on the number of STVs provided in the display device.

For example, after dividing the consecutive pixel rows whose minimum grayscales belong to a same grayscale level into a same pixel group, if the number of the divided pixel groups is greater than the preset threshold, it is indicated that the STVs provided in the display device cannot satisfy the refresh requirement. In this case, the divided pixel groups may be merged according to a preset rule. For example, if the number of rows of the pixel rows included in each of a plurality of consecutive pixel groups is less than a first preset threshold, the plurality of consecutive pixel groups may be merged into a same pixel group. Alternatively, if the minimum grayscales of two adjacent pixel groups belong to adjacent grayscale levels, the adjacent two pixel groups may be merged into a same pixel group. It could be understood that a corresponding STV needs to be provided for each pixel group such that the STV can return back to sequentially open the gates of each row in the corresponding pixel group to refresh the pixel voltages when the pixel voltages need to be refreshed. The first preset threshold for the number of rows included in each pixel group is related to the total number of rows of the pixel rows and the number of STVs, for example, the first preset threshold satisfies: the total number of rows/the number of STVs>the first preset threshold>1. It could be understood that the number of rows in the pixel groups after the merging does not exceed a preset row number described below.

Further, in an embodiment of the present disclosure, after dividing the consecutive pixel rows whose minimum grayscales belong to a same grayscale level into a same pixel group, the method further includes: determining whether the number of rows in each pixel group is greater than the preset row number; if the number of rows in any pixel group is greater than the preset row number, demerging the pixel group such that the number of rows in each pixel group after the demerging is smaller than the preset row number.

The preset row number may be determined according to the refresh rates for the plurality of pixel groups.

For example, it is assumed that the minimum grayscales of the pixel rows G121 to G1080 belong to a same grayscale level, but because the number of rows of the pixel rows G121 to G1080 is greater than the preset row number, the pixel rows G121 to G1080 may be demerged, for example, into two pixel groups, namely, one pixel group including pixel rows G121 to G600, and the other pixel group including pixel rows G601 to G1080, so as to meet the pixel refresh requirement.

In short, the M pixel rows may be divided into a plurality of pixel groups according to the minimum grayscale of each pixel row, each pixel group including one pixel row or a plurality of adjacent pixel rows, the refresh rate corresponding to each pixel group may be determined after the plurality of pixel groups are divided according to the minimum grayscale of each pixel row, for example, the refresh rate corresponding to the grayscale level to which the minimum grayscale in each pixel group belongs is taken as the refresh rate for the pixel group, and then the pixel voltages are refreshed for each pixel group according to the refresh rate corresponding to the pixel group.

For example, the pixel matrix may be divided, according to the minimum grayscale of each pixel row, into a plurality of pixel groups, for example, a first pixel group including the pixel rows G1 to G60, a second pixel group including the pixel rows G61 to G120, a third pixel group including the pixel rows G121 to G600, a fourth pixel group including the pixel rows G601 to G1080 and a fifth pixel group including the pixel rows G1081 to G1280, then the refresh rate corresponding to the grayscale level to which the minimum grayscale in the first pixel group including the pixel rows G1 to G60 belongs may be used as the refresh rate for the first pixel group including the pixel rows G1 to G60, and the pixel voltages of the first pixel group including the pixel rows G1 to G60 are refreshed at the refresh rate for the first pixel group including the pixel rows G1 to G60. For the second pixel group including the pixel rows G61 to G120, the third pixel group including the pixel rows G121 to G600, the fourth pixel group including the pixel rows G601 to G1080 and the fifth pixel group including the pixel rows G1081 to G1280, the refresh rates may be acquired and the pixel voltages may be refreshed in the same manners as the first pixel group including the pixel rows G1 to G60.

The method according to the embodiments of the present disclosure can refresh pixel voltages at different refresh rates according to grayscale information of image contents, thereby achieving the purpose of lowering the power consumption of the display device.

Figure 5:
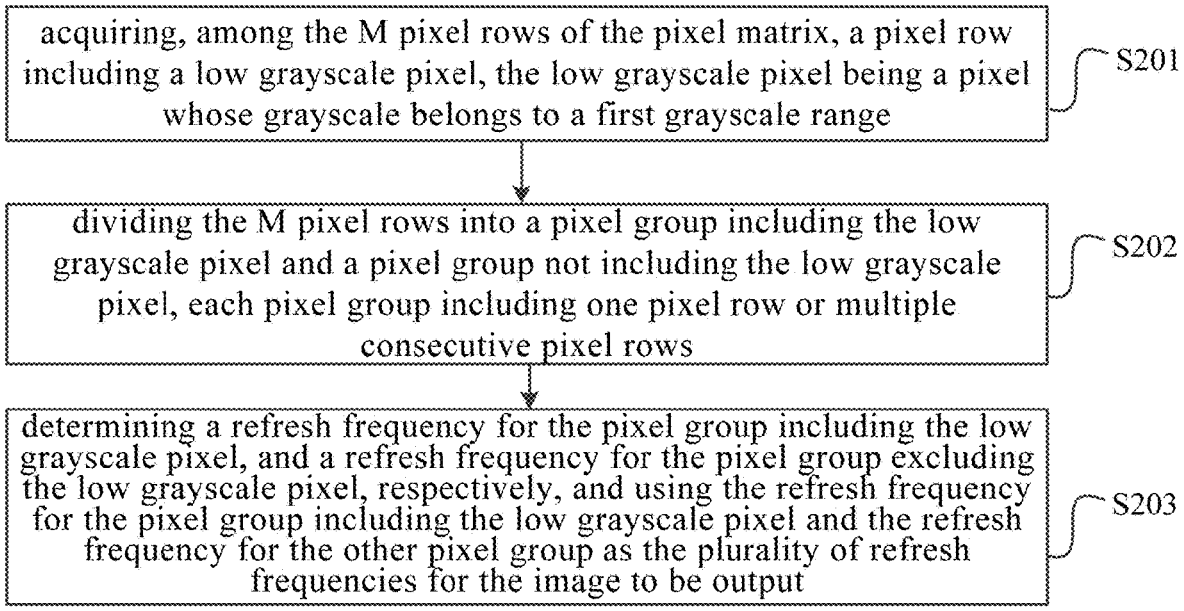
FIG. 5 is a flowchart of a display driving method of a display device according to another embodiment of the present disclosure.

According to an embodiment of the present disclosure, as shown in FIG. 5, determining a plurality of refresh rates for the image to be output according to the grayscale of each pixel may include steps S201-S203.

S201 includes: acquiring, among the M pixel rows of the pixel matrix, a pixel row including a low grayscale pixel, the low grayscale pixel being a pixel whose grayscale belongs to a first grayscale range.

Here, the first grayscale range may be the lowest grayscale level, for example, the sixth grayscale level including L32-L1 in Table 3.

S202 includes: dividing the M pixel rows into a plurality of pixel groups according to the pixel row including the low grayscale pixel, wherein each pixel group includes at least one pixel row.

In one embodiment, dividing the M pixel rows into a plurality of pixel groups according to the pixel row including the low grayscale pixel may include: sequentially determining whether each of the M pixel rows includes a low grayscale pixel; if the number of row(s) of the pixel row(s) between two adjacent rows each including the low grayscale pixel is less than a second preset threshold, dividing the two adjacent pixel rows each including the low grayscale pixel and the pixel row(s) between the two adjacent pixel rows each including the low grayscale pixel into a same pixel group; if the number of row(s) of the pixel row(s) between two adjacent pixel rows each including the low grayscale pixel is greater than or equal to the second preset threshold, dividing the two adjacent pixel rows each including the low grayscale pixel into two pixel groups, respectively, and dividing the pixel row(s) between the two adjacent pixel rows each including the low grayscale pixel into another pixel group. The second preset threshold is related to the total number of rows of the pixel rows in the pixel matrix and the number of STVs, and similar to the first preset threshold, the second preset threshold also satisfies: the total number of rows/the number of STVs>the second preset threshold>1.

For example, assuming that the previous pixel group includes a low grayscale pixel (i.e., a pixel having a grayscale L32), the current pixel group includes only one pixel row having the minimum grayscale L192, and the next pixel group also includes a low grayscale pixel (i.e., a pixel having a grayscale L32), in this case, it is unnecessary to assign one STV for the current pixel group (i.e., the one pixel row), and instead, the current pixel group (i.e., the one pixel row) is combined with the previous and next pixel groups. This is because assigning one STV for only one pixel row will not save the power consumption significantly, but additionally occupies one STV. For another example, assuming that the low grayscale pixel exists in each of the pixel rows G61 to G120, no low grayscale pixels exist in each of the pixel rows G121 to G600, and the low grayscale pixel exist in each of the pixel rows G601 to G1080, because the number of rows of the pixel rows between the two adjacent pixel rows each including the low grayscale pixel (i.e., between the pixel row G601 and the pixel row G120) is greater than the second preset threshold, the pixel rows G61 to G20 may be divided into a first pixel group, the pixel rows G121 to G600 may be divided into a second pixel group, and the pixel rows G601 to G1080 may be divided into a third pixel group.

Further, in another embodiment of the present disclosure, after dividing the M pixel rows into a plurality of pixel groups according to the pixel row including the low grayscale pixel, the method may further include: determining whether the number of rows in each pixel group is greater than a preset row number; if the number of rows in any pixel group is greater than the preset row number, demerging the pixel group such that the number of rows in each pixel group after the demerging is smaller than the preset row number. For example, if the number of rows of one pixel group is greater than the preset row number, the pixel group may be demerged into a plurality of pixel groups substantially equally such that the number of rows in each pixel group after the demerging is smaller than the preset row number.

The preset row number may be determined according to the refresh rates for the plurality of pixel groups.

For example, assuming that no low grayscale pixels exist in each of the pixel rows G121 to G1080, in a case where the number of rows of the pixel rows G121 to G1080 is greater than the preset row number, the pixel rows G121 to G1080 may be demerged, for example, into two pixel groups, namely, one pixel group including the pixel rows G121 to G600, and the other pixel group including the pixel rows G601 to G1080, so as to meet the pixel refresh requirement.

S203 includes: determining a refresh rate for the pixel group including the low grayscale pixel among the plurality of pixel groups, and a refresh rate for the pixel group other than the pixel group including the low grayscale pixel among the plurality of pixel groups, respectively, and using the refresh rate for the pixel group including the low grayscale pixel and the refresh rate for the other pixel group as the plurality of refresh rates for the image to be output.

Further, according to an embodiment of the present disclosure, determining a refresh rate for the pixel group including the low grayscale pixel among the plurality of pixel groups, and a refresh rate for the pixel group other than the pixel group including the low grayscale pixel among the plurality of pixel groups, respectively, includes: using, as the refresh rate for the pixel group including the low grayscale pixel, the refresh rate corresponding to the grayscale level to which the minimum grayscale in the pixel group including the low grayscale pixel belongs, and using, as the refresh rate for the other pixel group not including the low grayscale pixel, the refresh rate corresponding to the grayscale level to which the minimum grayscale in the other pixel group belongs; alternatively; using a first preset refresh rate as the refresh rate for the pixel group including the low grayscale pixel, and using a second preset refresh rate as the refresh rate for the other pixel group, the first preset refresh rate being greater than the second preset refresh rate.

That is, in the embodiment of the present disclosure, whether each pixel row of the pixel matrix includes the low grayscale pixel may be determined, in a case where the low grayscale pixel exists, the M pixel rows are divided into a pixel group including the low grayscale pixel and other pixel group not including the low grayscale pixel, and then, the refresh rate for the pixel group including the low grayscale pixel and the refresh rate for the other pixel groups not including the low grayscale pixel are determined. It could be understood that there may be a plurality of pixel groups each determined to include the low grayscale pixel, there may be a plurality of other pixel groups each determined to include no low grayscale pixel, and each pixel group includes one pixel row or multiple consecutive pixel rows.

Further, the refresh rate corresponding to the grayscale level to which the minimum grayscale in the pixel group including the low grayscale pixel belongs or the first preset refresh rate is taken as the refresh rate for the pixel group including the low grayscale pixel, at which refresh of the pixel voltages is performed on the pixel group including the low grayscale pixel. Similarly, the refresh rate corresponding to the grayscale level to which the minimum grayscale in the other pixel group not including the low grayscale pixel belongs or the second preset refresh rate is taken as the refresh rate for the other pixel group not including the low grayscale pixel, at which refresh of the pixel voltages is performed on the other pixel group not including the low grayscale pixel.

It should be noted that the foregoing embodiments can be applicable to the case where a gate driving circuit is used to control output, that is, the case where the pixel voltages of the pixel matrix are refreshed by the gate driving circuit of the display device.

In an embodiment, when a display device provided with a gate driving circuit such as a GOA and a Gate IC uses the gate driving circuit to control output, the display driving method of the display device according to the embodiments of the present disclosure is as follows.

a) TCON may detect the grayscale of each pixel of a plurality of pixels in the pixel matrix of the image to be output, and determine whether the grayscales of the plurality of pixels in the pixel matrix belong to a same grayscale level after acquiring the grayscale of each pixel. If the grayscales of the plurality of pixels in the pixel matrix belong to the same grayscale level, a single refresh rate may be determined for the whole image to be output according to relationship between grayscale and refresh rate determined in the debugging phase, and then the whole display device is refreshed at the refresh rate. For example, in a case where the grayscales of the plurality of pixels are all high grayscale pixels or only include 0 grayscale L0 and 255 grayscale L255 (e.g., mosaic, black on white, etc.) or are all 0 grayscale L0 (all black screen), the refresh rate may be reduced, that is, the refresh rate for the entire image to be output is determined according to the relationship between grayscale and refresh rate determined in the debugging phase, and then the whole display device is refreshed at the refresh rate. The high grayscale pixel is a pixel whose grayscale is in a second grayscale range, and the second grayscale range may be the maximum grayscale level, for example, the first grayscale level including L255-L225 in Table 3.

It could be understood that, in the case where the grayscales of the plurality of pixels are all 0 grayscale L0, or only include 0 grayscale L0 and 255 grayscale L255, the pixel voltages are refreshed for the plurality of pixels of the image to be output at the preset minimum refresh rate, for example, 1/a in Table 3. In the case where the grayscales of the plurality of pixels are in a same grayscale level, the refresh rate f corresponding to the grayscale level can be obtained according to the relationship between grayscale and refresh rate determined in the debugging phase, and the pixel voltages are refreshed for the plurality of pixels of the image to be output at the refresh rate f.

For a specific image, for example in the case where the display device enters the PSR Mode (panel self-refresh mode) or a still image is displayed, normal display of the image can be maintained using a low frame frequency.

This method of using TCON for image detection and then performing refresh globally at an appropriate refresh rate according to pixel brightness information of the image to be output can lower refresh rate and thus achieve low refresh frequency and low power consumption of the display device, as compared with the method of using a fixed refresh rate of 60 Hz or 120 Hz for the whole screen in the related art.

It could be understood that refresh may be started from the first row during the refresh.

b) when TCON detects that only several pixel rows of the image to be output include low grayscale pixels, for one or more pixel groups formed by the several pixel rows, the pixel voltages may be refreshed at a relatively high refresh rate, and for one or more pixel groups formed by the other pixel rows, the pixel voltages may be refreshed at a relatively low refresh rate. For example, in an image b, several pixels in the pixel rows G61 to G120 have the grayscales equal to or lower than L32, and the pixels in the other pixel rows all have the grayscales higher than L192, and the pixels in the pixel rows G61 to G120 are refreshed at a relatively high refresh rate f1 (e.g., 60 Hz), whereas the pixels in the other pixel rows are refreshed at a relatively low refresh rate f2 (e.g., 16 Hz).

In some embodiments, if there is no low grayscale pixel in the pixel matrix, the entire pixel matrix is configured as one pixel group, and pixel voltages are refreshed for the entire image to be output at the refresh rate corresponding to the grayscale level to which the minimum grayscale pixel in the pixel matrix belongs. For example, an image A is an image formed by combining grayscale L192 with grayscale L224, according to the above Table 3, the corresponding refresh rates are 1/c and 1/b, respectively, 1/c>1/b, and the TCON determines that refresh is performed at the refresh rate of 1/c.

Figure 3:
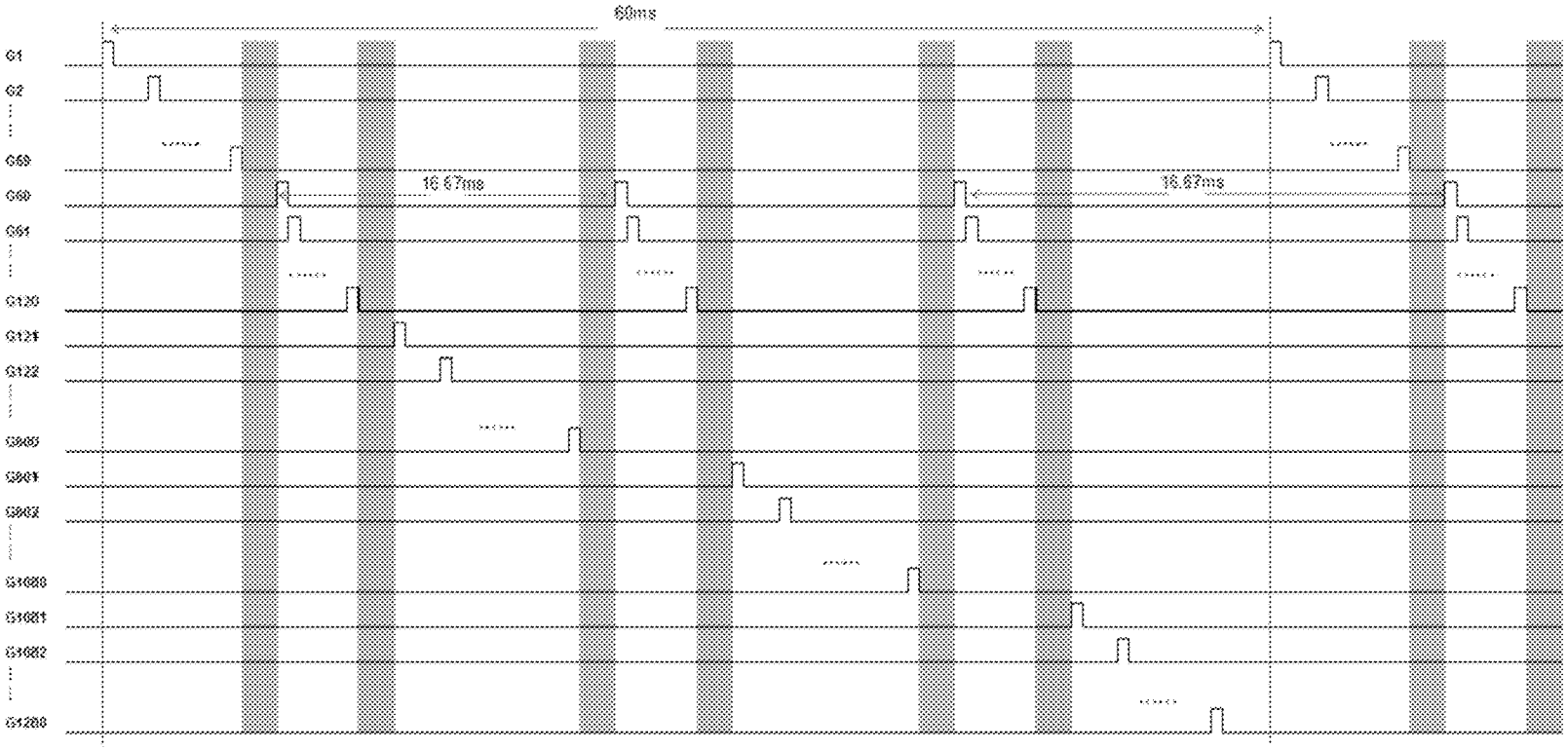
FIG. 3 is a diagram illustrating control principle of a high refresh rate and a low refresh rate in a display driving method of a display device according to an embodiment of the present disclosure.

Specifically, when refresh of the pixel voltages is performed on the pixel matrix through the gate driving circuit of the display device, an order in which the plurality of pixel groups are refreshed may be determined according to the refresh rates of the plurality of pixel groups, and the refresh of the pixel voltages are sequentially performed in the order. As shown in FIG. 3, the M pixel rows of the entire image may be divided into a plurality of pixel groups, for example, the second pixel group including the pixel rows G61 to G120 refreshed at a relatively high refresh rate, the first pixel group and the third pixel group to the fifth pixel group, (i.e., G1 to G60, G121 to G600, G601 to G1080, and G1081 to G1280) refreshed at a relatively low refresh rate. In this case, refresh of pixel voltages is performed sequentially on: G1 to G60, G61 to G120 (G61 to G120 are refreshed for the first time), G121 to G600, G61 to G120 (G61 to G120 are refreshed for the second time), G601 to G1080, G61 to G120 (G61 to G120 are refreshed for the third time), and G1081 to G1280, and in the meanwhile, corresponding frame synchronization signals (e.g., start vertical signals) STV, for example, STV1, STV2, STV3, STV2, STV4, STV2 and STV5, are configured. After an initial STV is enabled, STV1 is enabled, and the Gate IC may start to sequentially refresh pixel voltages of the first row to the 60th row G60; then STV2 is enabled, and the Gate IC starts to sequentially refresh pixel voltages of G61 to the 120th row G120; after that, STV3 is enabled, and the Gate IC starts to sequentially refresh pixel voltages of G121 to the 600th row G600; subsequently, the STV2 is enabled again, and the Gate IC starts to sequentially refresh pixel voltages of G61 to the 120th row G120, and so on. In this way, the Gate IC enables STV2 to refresh the contents of G61 to G120 on a cycle of less than T1 (T1=1/f1), for example, 16.67 ms, and pixels in the other pixel rows are refreshed at the relatively low refresh rate f2. The refresh rate may be controlled by an output control signal CLK, as an example, the output control signal CLK1 corresponding to STV2 may have a frequency equal to f1, and the output control signal CLK2 corresponding to STV1, STV3, STV4, and STV5 may have a frequency equal to f2.

It should be noted that the gate of the switching transistor in the pixel may be turned on or off by the frame synchronization signal STV together with the output control signal CLK. When the frame synchronization signal STV is at a high level, the gate of the switching transistor is turned on if the output control signal CLK is at a high level.

The method according to the embodiments of the present disclosure can refresh pixel voltages at different refresh rates according to grayscale information of image contents, thereby achieving the purpose of reducing the power consumption of the display device.

Figure 6:
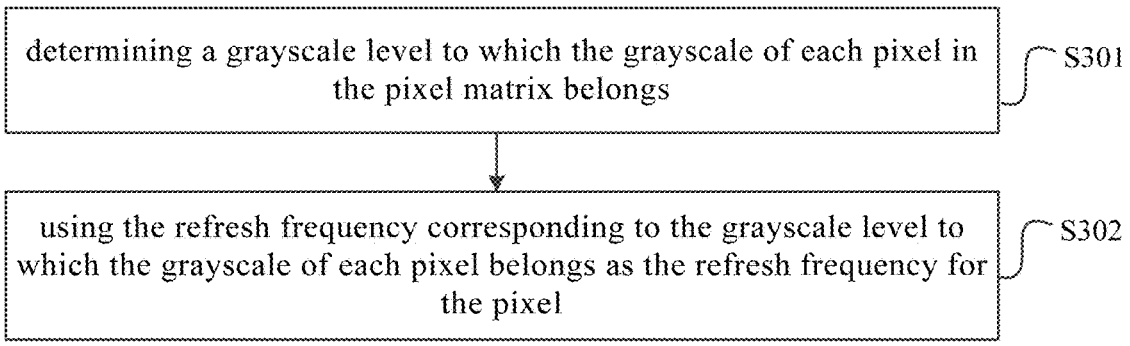
FIG. 6 is a flowchart of a display driving method of a display device according to still another embodiment of the present disclosure.

According to an embodiment of the present disclosure, as shown in FIG. 6, determining a plurality of refresh rates for the image to be output according to the grayscale of each pixel includes:

S301: determining a grayscale level to which the grayscale of each pixel in the pixel matrix belongs;

S302: using the refresh rate corresponding to the grayscale level to which the grayscale of each pixel belongs as the refresh rate for the pixel.

That is, the grayscale level to which the grayscale of each pixel in the pixel matrix belongs may be determined, the refresh rate for each pixel is determined according to the refresh rate corresponding to the grayscale level to which the grayscale of each pixel belongs, and then, the pixel voltage is refreshed for each pixel at the refresh rate for the pixel.

Figure 7:
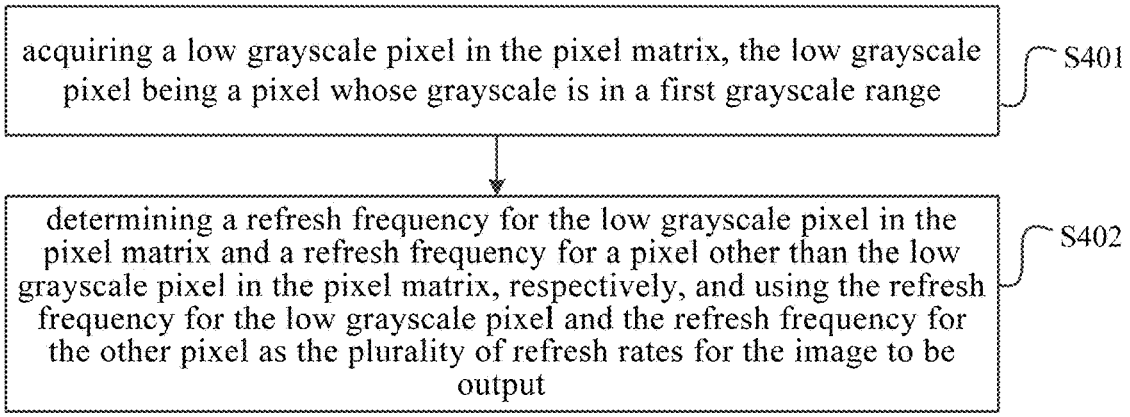
FIG. 7 is a flowchart of a display driving method of a display device according to yet another embodiment of the present disclosure.

According to an embodiment of the present disclosure, as shown in FIG. 7, determining a plurality of refresh rates for the image to be output according to the grayscale of each pixel includes:

S401: acquiring a low grayscale pixel in the pixel matrix, the low grayscale pixel being a pixel whose grayscale is in a first grayscale range; wherein the first grayscale range may be the lowest grayscale level, for example, the sixth grayscale level including L32-L1 in Table 3; and S402: determining a refresh rate for the low grayscale pixel in the pixel matrix and a refresh rate for a pixel other than the low grayscale pixel in the pixel matrix, respectively, and using the refresh rate for the low grayscale pixel and the refresh rate for the other pixel as the plurality of refresh rates for the image to be output.

Determining a refresh rate for the low grayscale pixel in the pixel matrix and a refresh rate for a pixel other than the low grayscale pixel in the pixel matrix, respectively may include:

using, as the refresh rate for the low grayscale pixel, the refresh rate corresponding to the grayscale level to which the minimum grayscale of the low grayscale pixel belongs, and using, as the refresh rate for the other pixel, the refresh rate corresponding to the grayscale level to which the minimum grayscale of the other pixel belongs;

alternatively, using a first preset refresh rate as the refresh rate for the low grayscale pixel, and using a second preset refresh rate as the refresh rate for the other pixel, wherein the first preset refresh rate being greater than the second preset refresh rate.

That is to say, when the refresh is performed through a source driving circuit, whether there is a low grayscale pixel in the pixel matrix may be determined, and if there is a low grayscale pixel, every pixel that is a low grayscale pixel is refreshed at a same refresh rate, and every pixel other than the low grayscale pixel is refreshed at another refresh rate. Furthermore, a refresh rate (i.e., a high refresh rate for the image to be output) for the low grayscale pixel in the image to be output and a refresh rate (i.e., a low refresh rate for the image to be output) for the pixel other than the low grayscale pixel (i.e., the pixel whose grayscale is not in the first grayscale range) may be determined. Then, the pixel voltage of the low grayscale pixel is refreshed at the high refresh rate for the image to be output, and the pixel voltage of the other pixel is refreshed at the low refresh rate for the image to be output.

In a case where refresh is performed through the source driving circuit, if there are a plurality of low grayscale pixels in the pixel matrix, a minimum grayscale of the plurality of low grayscale pixels and a minimum grayscale of the pixels other than the low grayscale pixels are determined, and the refresh rate corresponding to the grayscale level to which the minimum grayscale of the plurality of low grayscale pixels belongs is used as the high refresh rate for the image to be output, and the pixel voltages of the plurality of low grayscale pixels are refreshed at the high refresh rate for the image to be output; the refresh rate corresponding to the grayscale level to which the minimum grayscale of the other pixels belongs is used as the low refresh rate for the image to be output, and the pixel voltages of the other pixels are refreshed at the low refresh rate for the image to be output. Alternatively, if there are a plurality of low grayscale pixels in the pixel matrix, the first preset refresh rate is directly used as the high refresh rate for the image to be output, and the pixel voltages of the plurality of low grayscale pixels are refreshed at the first preset refresh rate; the second preset refresh rate is directly used as the low refresh rate for the image to be output, and the pixel voltages of the other pixels are refreshed at the second preset refresh rate.

In some embodiments, if there is no low grayscale pixel in the pixel matrix, the pixel voltages are refreshed for the entire image to be output at the refresh rate corresponding to the grayscale level to which the minimum grayscale pixel in the pixel matrix belongs. For example, an image A is an image including only pixels having grayscales of L192 and L224, according to the above Table 3, the suitable refresh rates are 1/c and 1/b, respectively, 1/c>1/b, and TCON determines that refresh is performed at the refresh rate of 1/c.

It should be noted that the foregoing embodiments can be applicable to the case where a source driving circuit is used to control output, that is, the case where the pixel voltages of the pixel matrix are refreshed by the source driving circuit of the display device.

In an embodiment, when a display device provided with a source driving circuit such as a Source IC uses the source driving circuit to control output, the display driving method of the display device according to the embodiments of the present disclosure is as follows.

a) TCON may detect the grayscale of each pixel of a plurality of pixels in the pixel matrix of the image to be output, and determine whether the grayscales of the plurality of pixels in the pixel matrix belong to a same grayscale level after acquiring the grayscale of each pixel. If the grayscales of the plurality of pixels in the pixel matrix belong to the same grayscale level, a single refresh rate may be determined for the whole image to be output according to relationship between grayscale and refresh rate determined in the debugging phase, and then the whole display device is refreshed at the refresh rate. For example, in a case where the grayscales of the plurality of pixels are all high grayscale pixels or only include 0 grayscale L0 and 255 grayscale L255 (e.g., mosaic, black on white, etc.) or are all 0 grayscale L0 (all black screen), the refresh rate may be lowered, that is, the refresh rate for the entire image to be output is determined according to the relationship between grayscale and refresh rate determined in the debugging phase, and then the whole display device is refreshed at the refresh rate. The high grayscale pixel is a pixel whose grayscale is in a second grayscale range, and the second grayscale range may be the maximum grayscale level, for example, the first grayscale level including L255-L225 in Table 3.

It could be understood that, in the case where the grayscales of the plurality of pixels are all 0 grayscale L0, or only include 0 grayscale L0 and 255 grayscale L255, the pixel voltages are refreshed for the plurality of pixels of the image to be output at the preset minimum refresh rate, for example, 1/a in Table 3. In the case where the grayscales of the plurality of pixels are in a same grayscale level, the refresh rate f corresponding to the grayscale level can be obtained according to the relationship between grayscale and refresh rate determined in the debugging phase, and the pixel voltages are refreshed for the plurality of pixels of the image to be output at the refresh rate f.

For a specific image having a relatively high grayscale, for example in the case where the display device enters the PSR Mode (panel self-refresh mode) or a still image is displayed, normal display of the image can be maintained using a low frame frequency.

It could be understood that the refresh may be started from the first row.

b) when TCON detects that only several pixel rows of the image to be output include low grayscale pixels, for one or more pixel groups formed by the several pixel rows, the pixel voltages may be refreshed at a relatively high refresh rate, and for one or more pixel groups formed by the other pixel rows, the pixel voltages may be refreshed at a relatively low refresh rate. The relatively low refresh rate may be implemented in an interval frame mode (which will be described later).

c) when the TCON detects that only several pixels in the image to be output are low grayscale pixels, for the several pixels, the pixel voltages may be refreshed at a relatively high refresh rate (e.g., a regular refresh rate of 60 Hz), and for the other pixels, the pixel voltages may be refreshed at a relatively low refresh rate. The relatively low refresh rate may be implemented in an interval frame mode (which will be described later).

According to an embodiment of the present disclosure, when refresh is performed by a source driving circuit, the source driving circuit controls the source of the corresponding switching transistor of each pixel to be in an output state at an interval according to the refresh rate for the pixel. As an example, controlling the source of the corresponding switching transistor of each pixel to be in an output state at an interval includes: determining an interval frame number C for each pixel according to the refresh rate for the pixel; and controlling the source of the switching transistor of the pixel to be in an output state at an interval of C frames.

Figure 8A:
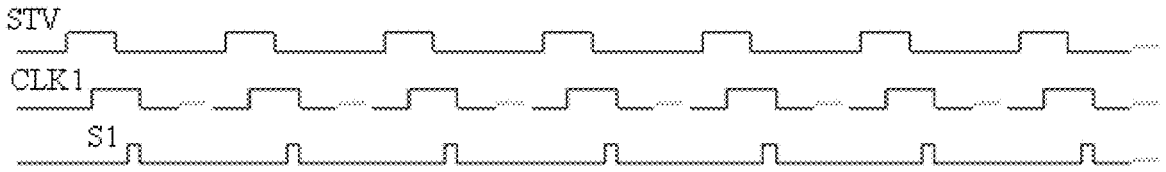
FIG. 8*a* is a schematic timing diagram of a normal refresh rate in a display driving method of a display device according to an embodiment of the present disclosure.
Figure 8B:
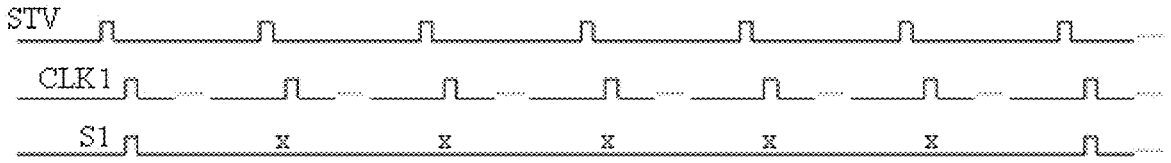
FIG. 8*b* is a schematic timing diagram of an interval frame refresh mode in a display driving method of a display device according to an embodiment of the present disclosure.

In an embodiment, as shown in FIG. 8*a*, when the refresh rate is the regular refresh rate, the source of the switching transistor is controlled to be in an output state continuously, that is, the source of the switching transistor is in an output state in each frame. As shown in FIG. 8*b*, when the refresh rate is lower than the regular refresh rate, the source of the switching transistor may be controlled to be in an output state at an interval, that is, the source of the switching transistor is in an output state at an interval of C frames, where C is a positive integer.

That is, the frame synchronization signal STV for the Gate IC/GOA may be output at a regular frequency, and the Source IC outputs in an interval frame mode according to the required refresh rate. As an example, as shown in FIGS. 8*a* and 8*b*, assuming that a source control signal corresponding to the pixel S(1, 1) is S1, and an output control signal CLK corresponding to the pixel S(1, 1) is CLK1, when S1 is at a high level, it means that the source of the switching transistor of the pixel S(1,1) has an output, and when S1 is at each x, it means that the output of the source driving circuit is floating and the source of the switching transistor of the pixel S(1, 1) has no output. It could be understood that although the gate of the switching transistor is turned on, the switching transistor cannot be charged and the pixel voltage is maintained, because the source of the switching transistor has no output.

It should be noted that, for refresh in the interval frame mode, if the gate of the switching transistor is turned on in advance, the charges held in the previous frame cannot be maintained (if the gate is turned on early, the charge stored in the previous frame in the N-th row is discharged completely after scanning to the (N-1)-th row or (N-2)-th row), therefore, in this case, the gate of the switching transistor should not be turned on in advance. In the embodiment as shown in FIG. 8*b*, the pixel S(1, 1) is refreshed to cause the source of the switching transistor of the pixel S(1, 1) to be in an output state every six frames (i.e., at an interval of six frames), and a time duration during which the frame synchronization signal STV is at a high level and a time duration during which the output control signal CLK is at a high level are reduced such that the frame synchronization signal STV and the output control signal CLK are at a high level only when controlling the gates of the pixels in the current row.

According to another embodiment of the present disclosure, when refresh is performed by a source driving circuit, if the plurality of pixels are refreshed at a single refresh rate, the frequency of the frame synchronization signal STV may be adjusted according to the refresh rate to lower the frequency of the STV to a low frequency, and meanwhile the source of the switching transistor is controlled to be in an output state continuously, that is, the source of the switching transistor is in an output state in each frame.

Thus, by changing the refresh mode of the pixel voltages, low power consumption and low frame frequency display of the display device can be realized, and the method according to the embodiments of the present disclosure is applicable to liquid crystal display devices such as A-si (amorphous silicon) or Oxide (oxide)-based liquid crystal display devices.

In summary, in the display driving method of the display device according to the embodiments of the present disclosure, a grayscale of each pixel in the pixel matrix of an image to be output by the display device is acquired, and a refresh type and a refresh rate for the image to be output are determined according to the grayscale of each pixel in the pixel matrix. Pixel voltages of pixel matrix are refreshed at a single determined refresh rate under a single-frequency refresh mode, or refreshed at a plurality of determined refresh rates under a multiple-frequency refresh mode. Therefore, the voltages of the pixels can be refreshed differently according to different grayscales of the pixels, thereby realizing low power consumption display without compromising on display quality.

In order to implement the above embodiments, the present disclosure also provides a display device.

Figure 9:
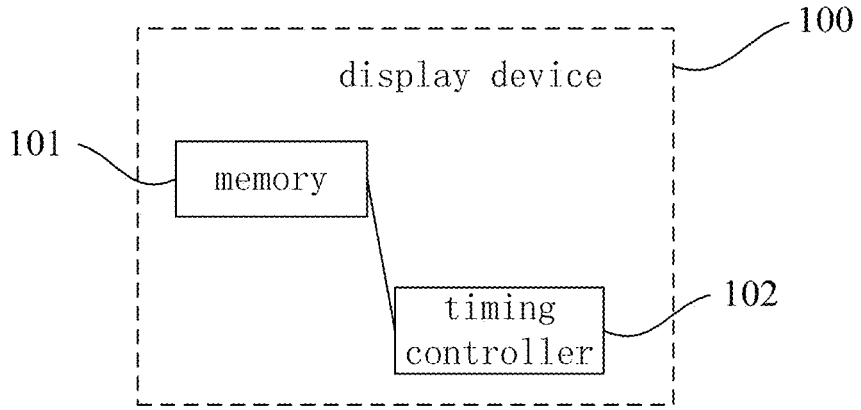
FIG. 9 is a schematic block diagram of a display device according to an embodiment of the present disclosure.

FIG. 9 is a schematic block diagram of a display device according to an embodiment of the present disclosure. As shown in FIG. 9, the display device 100 includes a memory 101, a timing controller 102, and a display driving program of the display device stored in the memory 101 and operable on the timing controller 102, and the timing controller 102 implements the display driving method of the display device in the above embodiments when executing the display driving program of the display device. In addition, it could be understood that the level corresponding to each grayscale and the refresh rate corresponding to each level (e.g., the contents in Table 3) acquired in the debugging phase may be stored in the memory 101.

In the display device according to the embodiment of the present disclosure, by using the above display driving method of the display device, the voltages of the pixels can be refreshed differently according to different grayscales of the pixels, thereby realizing low power consumption display without compromising on display quality.

In order to implement the above embodiments, the present disclosure also provides a non-transitory readable storage medium having a display driving program of a display device stored thereon, and the display driving program of the display device implements the display driving method of the display device in the above embodiments when being executed by a timing controller.

The non-transitory readable storage medium according to the embodiment of the present disclosure, by using the above display driving method of the display device, can refresh the voltages of the pixels differently according to different grayscales of the pixels, thereby realizing low power consumption display without compromising on display quality.

In the description of the present specification, the description with reference to the terms "one embodiment", "some embodiments", "an example", "specific example", "some examples", or the like means a specific characteristic, structure, material, or feature described in connection with the embodiment or example is included in at least one embodiment or example of the present disclosure. The appearances of the foregoing terms in various places throughout this specification are not necessarily referring to the same embodiment or example of the present disclosure. Furthermore, the specific characteristic, structure, material, or feature described may be combined in a suitable manner in any one or more embodiments or examples. In addition, various embodiments or examples described in the specification as well as features of various embodiments or examples may be combined by those skilled in the art without contradicting each other.

Moreover, the terms "first" and "second" are used for descriptive purposes only and are not intended to be construed as indicating or implying relative importance or implicitly indicating the number of indicated technical features. Thus, features defined by "first" or "second" may include at least one of the features, either explicitly or implicitly. In the description of the present disclosure, "a plurality of" means at least two, for example, two, three, etc., unless specifically defined otherwise.

Any process or method described in the flowchart or described in other way herein may be understood to represent a module, a segment, or a portion of code comprising one or more executable instructions for implementing specified logic functions or steps of processes. The range of the preferred embodiments include other implementations, in which the functions may be performed not in the order illustrated or discussed, but in a substantially simultaneous manner or in the reverse order, depending upon the functions involved, and this shall be appreciated by a person skilled in the art to which the embodiments of the present disclosure pertain.

The logics and/or steps in the flowcharts or described in other ways herein, for example, may be regarded as an ordered list of executable instructions for implementing the logic functions, and can be embodied in any computer readable medium, so as to be used by an instruction execution system, an apparatus or a device (e.g., computer-based system, system including processor, or other system that can extract instruction from the instruction execution system, the apparatus or the device and then execute the instruction), or used in conjunction with the instruction execution system, the apparatus or the device. In the Specification, "computer readable medium" may be any apparatus that can include, store, communicate, propagate or transmit program to be used by an instruction execution system, apparatus or device, or be used in conjunction therewith. More detailed examples of the computer readable medium include (non-exhaustive list): electrical connection portion (electronic apparatus) having one or more wirings, portable computer disk (magnetic apparatus), random access memory (RAM), read only memory (ROM), Erasable Programmable Read Only Memory (EPROM or flash memory), optical fiber, and portable compact disc-read only memory (CDROM). Besides, a program can be electronically captured by optically scanning a paper sheet or other medium on which the program is printed, then the program is compiled, interpreted, or processed in other appropriate way when necessary, next the program is stored in the computer memory, thus the computer readable medium even may be a paper sheet or other appropriate medium on which the program is printed.

It should be understood that portions of the present disclosure can be implemented in hardware, software, firmware, or a combination thereof. In the above implementations, multiple steps and methods may be implemented by software or firmware stored in a memory and executed by a suitable instruction execution system. For example, if implemented in hardware, as in another implementation, they may be implemented by any one or combination of the following techniques in the art: discrete logic circuit having logic gate circuitry configured to perform logic operations on data signals, application specific integrated circuits (ICs) having suitable combinational logic gate circuitry, programmable gate arrays (PGAs), field-programmable gate arrays (FPGAs), etc.

One of ordinary skill in the art can understand that all or part of the steps in the method of the above embodiments may be implemented by instructing a related hardware through a program, and the program may be stored in a computer readable storage medium. The program is executed to implement one or a combination of the steps of the method of the embodiments.

In addition, various functional units in the embodiments of the present disclosure may be integrated into one processing module, or each unit may exist physically separately, or two or more units may be integrated into one module. The integrated module may be implemented in the form of hardware or in the form of software functional module. The integrated module, if implemented in the form of software functional module and sold or used as a separate product, may also be stored in a computer readable storage medium.

The storage medium mentioned above may be a read only memory, a magnetic disk, an optical disk, or the like. The embodiments of the present disclosure have been illustrated and described above, but it can be understood that the embodiments described above are exemplary and shall not be construed as limiting the scope of the present disclosure. One of ordinary skill in the art may make changes, modifications, substitutions and variations to the above embodiments within the scope of the present disclosure.

The invention claimed is:

1. A display driving method of a display device, comprising steps of:

acquiring a grayscale of each pixel in a pixel matrix of an image to be output by the display device, wherein the pixel matrix comprises a plurality of pixels in a plurality of pixel rows, and each of the plurality of pixel rows comprises multiple pixels;

determining a refresh type and a refresh rate for the image to be output according to the grayscale of each pixel in the pixel matrix, wherein the refresh type comprises a single-frequency refresh and a multi-frequency refresh; and refreshing pixel voltages of the pixel matrix at a single determined refresh rate under the single-frequency refresh, or refreshing the pixel voltages of the pixel matrix at a plurality of determined refresh rates under the multi-frequency refresh.

2. The display driving method of a display device of claim 1, wherein determining a refresh type and a refresh rate for the image to be output according to the grayscale of each pixel in the pixel matrix comprises:

determining whether the grayscale of each pixel in the pixel matrix belongs to a same grayscale level, wherein each grayscale level includes a plurality of grayscales; and if the grayscale of each pixel in the pixel matrix belongs to the same grayscale level, determining that the refresh type for the image to be output is the single-frequency refresh, and using a refresh rate corresponding to the same grayscale level as the refresh rate for the image to be output;

if the grayscales of the plurality of pixels in the pixel matrix belong to at least two different grayscale levels, determining that the refresh type for the image to be output is the multi-frequency refresh, and determining a plurality of refresh rates for the image to be output according to the grayscale of each pixel.

3. The display driving method of a display device of claim 2, wherein determining a plurality of refresh rates for the image to be output according to the grayscale of each pixel comprises:

acquiring a minimum grayscale of each of the plurality of pixel rows of the pixel matrix;

dividing the plurality of pixel rows into a plurality of pixel groups according to the minimum grayscale of each of the plurality of pixel rows, wherein each of the plurality of pixel groups comprises at least one pixel row; and using a refresh rate corresponding to the grayscale level to which a minimum grayscale of each pixel group belongs as the refresh rate for the pixel group.

4. The display driving method of a display device of claim 3, wherein dividing the plurality of pixel rows into a plurality of pixel groups according to the minimum grayscale of each of the plurality of pixel rows comprises:

determining whether the minimum grayscale of each pixel row and the minimum grayscale of an adjacent pixel row belong to a same grayscale level; and dividing consecutive pixel rows whose minimum grayscales belong to a same grayscale level into a same pixel group.

5. The display driving method of a display device of claim 4, further comprising, after dividing consecutive pixel rows whose minimum grayscales belong to a same grayscale level into a same pixel group, steps of: determining a number of the divided pixel groups, and determining whether the number of the divided pixel groups is greater than a preset threshold; if the number of the divided pixel groups is greater than the preset threshold, merging the divided pixel groups such that the number of the pixel groups after the merging is smaller than or equal to the preset threshold.

6. The display driving method of a display device of claim 5, wherein merging the divided pixel groups comprises: merging a plurality of consecutive pixel groups in each of which the number of rows of the pixel rows is smaller than a first preset threshold into a same pixel group; or merging two adjacent pixel groups whose minimum grayscales belong to adjacent grayscale levels into a same pixel group.

7. The display driving method of a display device of claim 3, further comprising, after dividing the plurality of pixel rows into a plurality of pixel groups according to the minimum grayscale of each of the plurality of pixel rows, steps of: determining whether a number of rows in each of the plurality of pixel groups is greater than a preset row number; if the number of rows in any of the plurality of pixel groups is greater than the preset row number, demerging the pixel group such that the number of rows in each pixel group after the demerging is smaller than the preset row number.

8. The display driving method of a display device of claim 2, wherein determining a plurality of refresh rates for the image to be output according to the grayscale of each pixel comprises:

acquiring, among the plurality of pixel rows of the pixel matrix, a pixel row comprising a low grayscale pixel, wherein the low grayscale pixel is a pixel whose grayscale belongs to a first grayscale range having the lowest grayscale level;

dividing the plurality of pixel rows into a plurality of pixel groups according to the pixel row comprising the low grayscale pixel, wherein each of the plurality of pixel groups comprises at least one pixel row; and determining a refresh rate for the pixel group comprising the low grayscale pixel in the plurality of pixel groups and a refresh rate for other pixel group than the pixel group comprising the low grayscale pixel in the plurality of pixel groups, respectively, and using the refresh rate for the pixel group comprising the low grayscale pixel and the refresh rate for the other pixel group as the plurality of refresh rates for the image to be output.

9. The display driving method of a display device of claim 8, wherein determining a refresh rate for the pixel group comprising the low grayscale pixel and a refresh rate for other pixel group, respectively, comprises:

using, as the refresh rate for the pixel group comprising the low grayscale pixel, a refresh rate corresponding to a grayscale level to which a minimum grayscale in the pixel group comprising the low grayscale pixel belongs, and using, as the refresh rate for the other pixel group not comprising the low grayscale pixel, a refresh rate corresponding to a grayscale level to which a minimum grayscale in the other pixel group belongs; or, using a first preset refresh rate as the refresh rate for the pixel group comprising the low grayscale pixel, and using a second preset refresh rate as the refresh rate for the other pixel group, the first preset refresh rate being greater than the second preset refresh rate.

10. The display driving method of a display device of claim 8, wherein dividing the plurality of pixel rows into a plurality of pixel groups according to the pixel row comprising the low grayscale pixel comprises: sequentially determining whether the low grayscale pixel is included in each of the plurality of pixel rows, if a number of rows of pixel rows between two adjacent pixel rows each comprising the low grayscale pixel is smaller than a second preset threshold, dividing the two adjacent pixel rows each comprising the low grayscale pixel and the pixel rows therebetween into a same pixel group, and if the number of rows of the pixel rows between the two adjacent pixel rows each comprising the low grayscale pixel is greater than or equal to the second preset threshold, dividing the two adjacent pixel rows each comprising the low grayscale pixel into two pixel groups, and dividing the pixel rows between the two adjacent pixel rows each comprising the low grayscale pixel into another pixel group.

11. The display driving method of a display device of claim 8, further comprising, after dividing the plurality of pixel rows into a plurality of pixel groups according to the pixel row comprising the low grayscale pixel, steps of: determining whether a number of rows in each of the plurality of pixel groups is greater than a preset row number, if the number of rows in any of the plurality of pixel groups is greater than the preset row number, demerging the pixel group such that the number of rows in each pixel group after the demerging is smaller than the preset row number.

12. The display driving method of a display device of claim 2, wherein determining a plurality of refresh rates for the image to be output according to the grayscale of each pixel comprises:

determining a grayscale level to which a grayscale of each pixel in the pixel matrix belongs; and using a refresh rate corresponding to the grayscale level to which the grayscale of each pixel belongs as the refresh rate for the pixel.

13. The display driving method of a display device of claim 2, wherein determining a plurality of refresh rates for the image to be output according to the grayscale of each pixel comprises:

acquiring a low grayscale pixel in the pixel matrix, the low grayscale pixel being a pixel whose grayscale belongs to a first grayscale range having the lowest grayscale level; and determining a refresh rate for the low grayscale pixel in the pixel matrix and a refresh rate for other pixel than the low grayscale pixel in the pixel matrix, respectively, and using the refresh rate for the low grayscale pixel and the refresh rate for the other pixel as the plurality of refresh rates for the image to be output.

14. The display driving method of a display device of claim 13, wherein determining a refresh rate for the low grayscale pixel and a refresh rate for the other pixel, respectively comprises:

using, as the refresh rate for the low grayscale pixel, a refresh rate corresponding to a grayscale level to which a minimum grayscale of the low grayscale pixel belongs, and using, as the refresh rate for the other pixel, a refresh rate corresponding to a grayscale level to which a minimum grayscale of the other pixel belongs; or using a first preset refresh rate as the refresh rate for the low grayscale pixel, and using a second preset refresh rate as the refresh rate for the other pixel, the first preset refresh rate being greater than the second preset refresh rate.

15. The display driving method of a display device of claim 1, wherein the pixel voltages of the pixel matrix are refreshed by a gate driving circuit or a source driving circuit of the display device, in a case of refreshing the pixel voltages by the source driving circuit, the source driving circuit controls, according to the refresh rate for each pixel, a source of a switching transistor of the pixel to be in an output state at an interval.

16. The display driving method of a display device of claim 15, wherein controlling the source of the switching transistor of the pixel to be in an output state at an interval comprises:

determining an interval frame number C for each pixel according to the refresh rate for each pixel; and controlling the source of the switching transistor of the pixel to be in an output state at an interval of C frames, where C is a positive integer.

17. The display driving method of a display device of claim 1, wherein in response to a still image displayed by the display device or a panel self-refresh mode of the display device, the grayscale of each pixel in the pixel matrix of the image to be output by the display device is acquired.

* * * * *